US005340173A

United States Patent [19]

Bethel

[11] Patent Number: 5,340,173

[45] Date of Patent: Aug. 23, 1994

[54] DOOR SECURITY DEVICE

[76] Inventor: Stanley C. Bethel, 1912 W. 11th St., Irving, Tex. 75060

[21] Appl. No.: 98,527

[22] Filed: Jul. 28, 1993

[51] Int. Cl.[5] ..... E05C 19/18

[52] U.S. Cl. ..... 292/288; 292/343; 292/DIG. 15

[58] Field of Search ..... 292/288, 339, 343, DIG. 15, 292/DIG. 28

[56] References Cited

U.S. PATENT DOCUMENTS

| | | | |
|---|---|---|---|
| 642,261 | 1/1990 | Ruppman | 292/DIG. 15 X |
| 709,057 | 9/1902 | Smith | 292/339 |
| 723,478 | 3/1903 | Mills | 292/DIG. 15 X |
| 932,694 | 8/1909 | Fulton et al. | 292/343 |
| 1,082,432 | 12/1913 | Mertsheimer | 292/DIG. 15 X |
| 1,895,146 | 1/1933 | Brown | 292/DIG. 15 X |
| 2,631,402 | 5/1949 | Hopkins . | |
| 3,328,065 | 6/1967 | Arenson | 292/343 |
| 3,572,800 | 3/1971 | Graziano . | |
| 4,142,752 | 3/1979 | Chilton | 292/DIG. 15 X |
| 4,198,088 | 4/1979 | Tochihara . | |
| 4,230,353 | 10/1979 | Bjorgum | 292/343 |
| 4,231,599 | 12/1979 | Gayman . | |
| 4,300,796 | 11/1980 | Lane . | |
| 4,483,558 | 11/1984 | Van Meter . | |
| 4,585,259 | 4/1986 | Vidas . | |
| 4,630,854 | 12/1986 | Persson et al. | 292/343 |
| 4,657,293 | 4/1987 | Bell | 292/339 |
| 4,890,092 | 12/1989 | Grimm . | |
| 5,056,836 | 10/1991 | Wells | 292/DIG. 15 X |
| 5,114,194 | 5/1992 | Toifl et al. | 292/DIG. 28 X |
| 5,207,464 | 5/1993 | Reeves, Jr. | 292/339 |

FOREIGN PATENT DOCUMENTS

| | | | |
|---|---|---|---|
| 1267568 | 5/1968 | Fed. Rep. of Germany | 292/343 |

*Primary Examiner*—Rodney M. Lindsey
*Attorney, Agent, or Firm*—William D. Jackson

[57] ABSTRACT

A door security device comprising an elongated body member which has a head section at one end adapted for employment in proximity to a door, a reduced intermediate section, and a gripping section at the other end, adapted to engage the floor of the room into which the door opens. The gripping section is provided with a bottom facing having a downwardly depending stop adapted to engage the horizontal floor surface of the room in a gripping action and limit movement of the elongated body member upon the application of a horizontal force component through the head section. The head section comprises a generally vertical bumper face adapted to contact the door near the floor to provide a relatively shallow acute angle between the bumper face and the stop of the gripping section. The head section has a rearwardly projecting ledge portion terminating in a vertical bumper face adapted to engage the door in an abutting relationship near the bottom of the door and a pedestal portion which is displaced inwardly from the bumper face. The pedestal portion extends downwardly from the ledge portion, which is thus spaced above the floor, to a pedestal face adapted to engage the floor. The intermediate section is of a generally arched-shaped configuration to facilitate handling of the elongated body member. An alarm is incorporated into the door security device along with a switch for the alarm and a contact means in the bumper face for activating the switch.

23 Claims, 3 Drawing Sheets

DOOR SECURITY DEVICE

FIELD OF THE INVENTION

This invention relates to a door security system and more particularly to systems for preventing the intrusive opening of a door by establishing an abutting relationship with the interior surface of a door at near the bottom thereof.

BACKGROUND OF THE INVENTION

Various systems have been proposed to provide security against unauthorized opening of a door leading to dwelling interiors such as houses, apartments, hotel rooms and the like. Such systems have incorporated devices to be placed against the door in a temporary and easily removable configuration. U.S. Pat. Nos. 4,300,796 to Lane and 4,483,558 to Van Meter, disclose door security devices of the type which engage the door at the door knob or immediately below the door knob and extend from there down to the floor at an acute angle. These systems are formed of elongated rod like or tubular members in a telescoping relationship. As disclosed in the patent to Van Meter, the security device has a rotatable floor engaging shoe fitted on one side with a skid pad having a relatively high coefficient of friction, e.g. formed of rubber or a rubber-like plastic, for use on smooth floor surfaces and on the other side a plurality of downwardly projecting teeth which are adapted to penetrate into and engage a carpet. Devices of this nature are necessarily somewhat bulky and unwieldy.

Another approach which involves a relatively compact device is disclosed in U.S. Pat. No. 4,585,259 to Vidas. The Vidas device takes the form of a base member having a door abutting member at one end and a door frame engaging member at the other end. Intermediate of the door abutting and frame engaging members is an upright support member which carries a threaded stopper so that the door can be interposed between the abutting face of the abutting member and the stopper. The upright support member is also provided with foot members which extend downwardly from the upright support to engage the floor in the event the frame engaging member is not operative. A substantially simpler arrangement is disclosed in U.S. Pat. No. 4,890,092 to Grimm. The Grimm device incorporates a wedge shaped housing which is adapted to be forced underneath the lower edge of the door. The tapered surface of the wedge incorporates a switch for an audible alarm at the rear wall of the housing. Various inserts having traction projections for frictional engagement with smooth surfaces or hooked-shaped fasteners for fabric surfaces may be incorporated at the bottom of the housing. In the event of an unauthorized opening of the door, the switch is depressed to complete a circuit through a battery in the housing and the alarm to sound the audible alarm signal.

SUMMARY OF THE INVENTION

In accordance with the present invention, there is provided a novel door security system which is readily transportable and easily removed and installed. This system provides an effective barrier against unauthorized opening of a door by abutting the door near the bottom thereof.

In accordance with one embodiment of the present invention, there is provided a door security device comprising an elongated body member which has a head section adapted for employment in proximity to a door and a gripping section spaced longitudinally from the head section and adapted to engage the floor of the room into which the door opens. The gripping section is provided with a bottom facing which has a stop secured thereto. The stop depends downwardly from the bottom facing to engage the horizontal floor surface of the room in a gripping action and limit movement of the elongated body member upon the application of a horizontal force component through the head section. The head section comprises a generally vertical bumper face which, when the security device is in place, is adapted to engage the door near the bottom thereof in an abutting relationship. The bumper face contacts the door near the floor to provide a relatively shallow acute angle between the bumper face and the stop means of the gripping section so that both vertical and horizontal force components are applied in the event an attempt is made to open the door. More specifically, the bumper face is angularly displaced vertically from the stop means by an angle of about 25° or less from the horizontal.

Preferably, the slope of the line extending from the vertical mid point of the bumper face to the horizontal mid point of the stop means on the bottom facing is within the range of 15°–20°. The bumper face preferably is inclined slightly from the vertical in the direction of the gripping section by an angle in the range of 1°–3°.

In a further aspect of the invention, the elongated body member of a door security device embodying the invention is characterized as having a rearward head section, a forward gripping section and an intermediate section of reduced width extending longitudinally between the head and gripping section. The head section has a rearwardly projecting ledge portion. The ledge portion terminates in a terminus having a generally vertical bumper face adapted to engage a door in an abutting relationship near the bottom of the door. The head section further includes a pedestal portion which is displaced inwardly from the bumper face. The pedestal portion extends downwardly from the ledge portion, which is thus spaced above the floor, to a pedestal face adapted to engage the floor. The gripping section has a bottom facing having stop means as described previously. The intermediate section extends forwardly and downwardly from the head section to the gripping section. The intermediate section is of a generally arched-shaped configuration between the pedestal portion and the gripping section so that when the device is in place, there is a space between the intermediate section and the floor to facilitate handling of the elongated body member.

In yet a further aspect of the invention, an alarm is incorporated into the door security device along with a switch for the alarm and a contact means in the bumper face for activating the switch. Preferably, the alarm means is located in the pedestal portion and is positioned there to produce an audio alarm in which acoustic energy is directed outwardly from an upper portion of the pedestal portion along the underside at a reduced intermediate section. In yet a further embodiment of the invention, the system may be provided with a bite-shaped channel lock which is adapted to fit around the vertical edge of the door. Flexible connecting means are provided to interconnect the channel lock and the elongated body member.

DETAILED DESCRIPTION OF THE INVENTION

Figure 1:
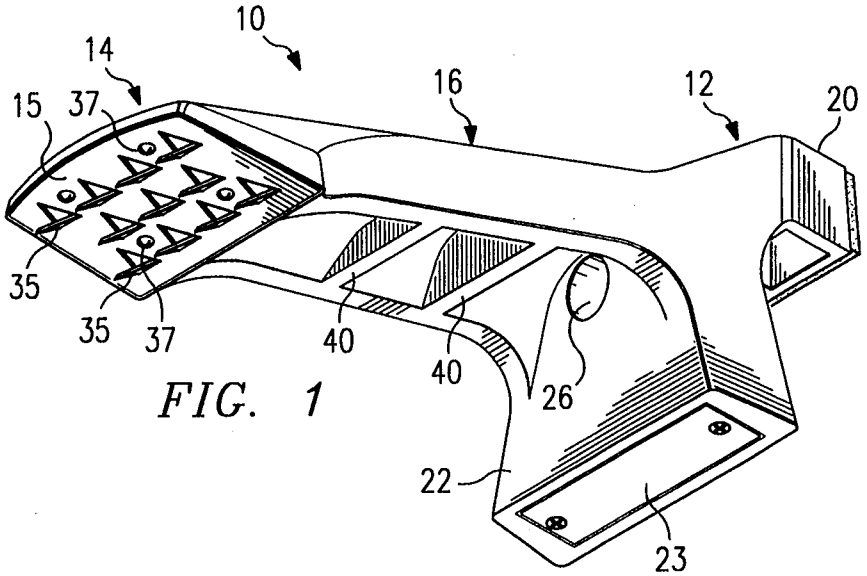
FIG. 1 a bottom perspective view of a door security device embodying the present invention.

Turning first to FIG. 1 there is illustrated a bottom perspective view of one embodiment of the invention equipped with gripping teeth for use in a room having a carpeted floor. As shown in the drawing, the door security device takes the form of an elongated body member 10 which can be characterized in terms of a rearward head section 12, a forward gripping section 14 having a bottom facing 15, and an intermediate section 16 which extends between the head section and gripping section. The intermediate section is of a reduced cross-sectional configuration which, as shown in FIG. 1 and also in the side elevational view of FIG. 2, provides an arch-shaped configuration indicated generally by reference numeral 18, which facilitates handling of the system.

Figure 2:
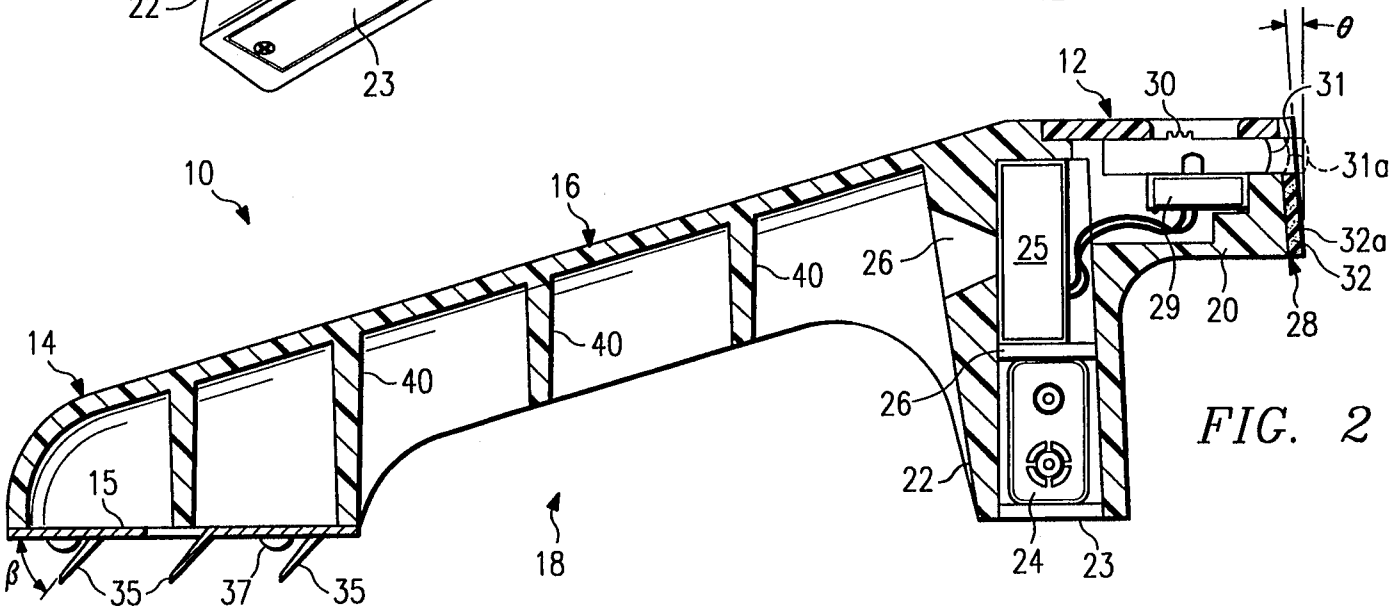
FIG. 2 a side elevational view with parts broken away showing details of an alarm system embodying in the invention.

As best shown in FIG. 1 and the side elevational view of FIG. 2, the head section 12 includes a rearwardly projecting ledge portion 20 and an inwardly spaced, downwardly extending pedestal portion 22 which is provided with a bottom cover plate 23. The pedestal portion houses an alarm system power source 24 such as a 9 V D.C. battery and an audio alarm generator 25 such as a piezoelectric transducer which is supported on a transverse plate member 21 within the pedestal 22. As best shown in FIG. 1, the transducer generates acoustic energy which is transmitted to the exterior of the pedestal via an opening 26 along the underside of the reduced intermediate section. The rearwardly extending ledge portion terminates in a generally vertical bumper face 28 which preferably is inclined slightly from the vertical as described below. The ledge portion houses a switch 29 having an actuator 30 which terminates in a contact face 31 protruding from the generally vertical bumper face in an operative state. The bumper face 28 preferably is provided with a high traction friction engaging surface such as may be provided by a ⅛" thick rubber facing 32.

Figure 3A:
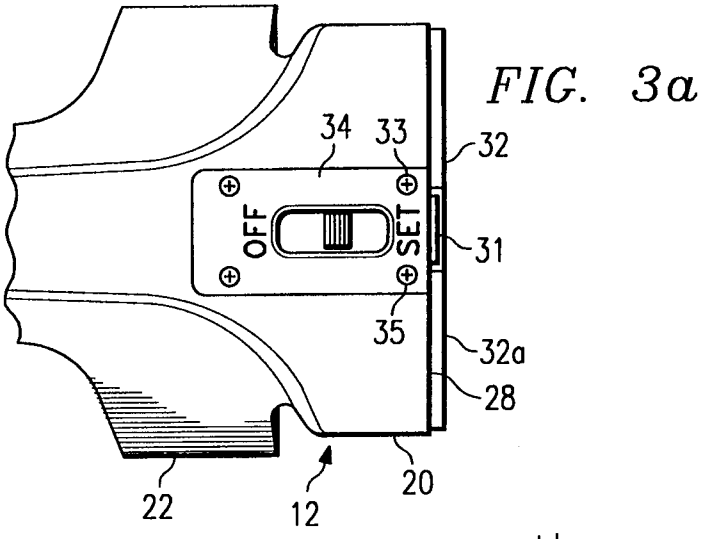
FIG. 3*a* is a plan view of the head section of the door security device showing an alarm switch in an "on" position.
Figure 3:
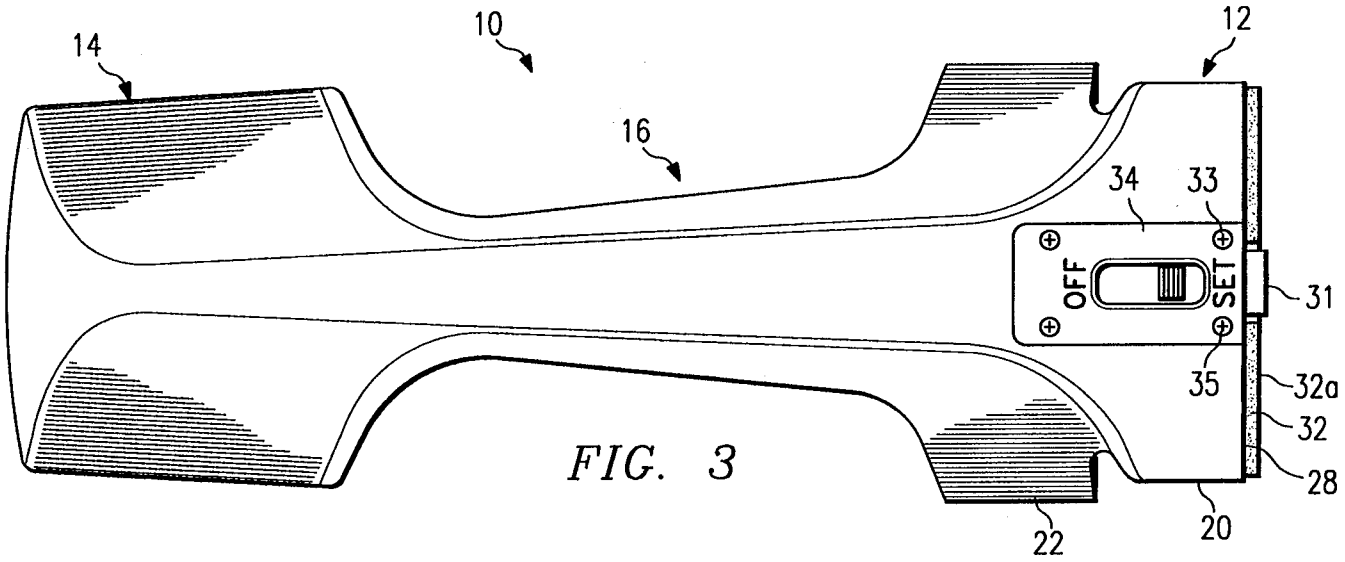
FIG. 3 plan view of the door security device.

Referring to FIG. 2 and also to FIGS. 3 and 3*a*, the switch 29 is a 3 position, 2-way switch having two "off" positions and one "on" position. The switch is held in place within the ledge portion by means of a cover plate 34 secured to the top of ledge 20 by screws 33. In the first off position depicted in FIG. 2, the switch actuator 30 is completely retracted within the ledge in the forward position as shown. This arrangement greatly reduces the likelihood of the audio alarm system being accidentally triggered. In the second off position, illustrated in FIG. 3, the switch actuator 30 projects outwardly from the ledge portion 20 and preferably to a position where it projects very slightly beyond the surface 32*a* of the elastomeric material 32. For example, the contact face 31 of the switch actuator may project about 3/32"–⅛" beyond the surface 32*a* of the facing material.

In the third "on" position, illustrated in FIG. 3*a* and by broken line 31*a* in FIG. 2, the switch projects slightly beyond the ledge face 28 but is depressed slightly with respect to the surface 32*a*. As can be seen from consideration of FIGS. 2, 3 and 3*a*, this arrangement guards against accidental triggering of the alarm system, while at the same time ensuring that an alarm will be generated if any significant force is applied against the door security device because of an unauthorized intrusive opening of the door. Referring further to FIG. 2, the end surface of the bumper face 32*a* is inclined very slightly from the vertical by an angle $\Theta$, with the bottom facing 15 and the bottom of the pedestal lying in a horizontal plane. Preferably, the angle $\Theta$ is within the range 1°–3°, normally 2°.

The cover plate 34 provides for ready access to the interior of the ledge portion of the head section where the switch mechanism and associated wiring are housed. The bottom portion of the pedestal 22 is also provided with a cover plate 23 held in place by sheet metal screws. Removal of the cover plate 23, of course, accommodates replacement of the battery 24 and permits access to plate member 21 which can be removed along with the transducer 25.

As shown in FIGS. 1 and 2, the intermediate section 16 extends horizontally and slightly downwardly so that when a horizontal force is applied against surface 32*a*, the corresponding force applied to the gripping section 14 has both vertical and horizontal components. In contrast to systems such as depicted in the aforementioned patents to lane and Van Meter, the horizontal force component is by far the predominate force component involved when employing the system of the present invention.

Figure 4:
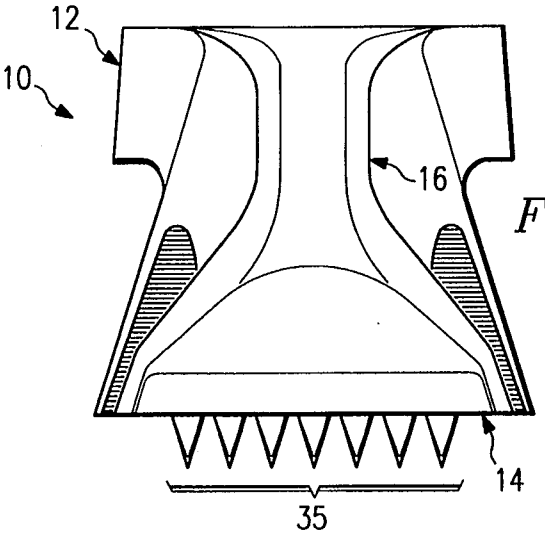
FIG. 4 is a front view of the door security device.

FIGS. 1 and 2 illustrate a preferred form of stop on the bottom facing of the gripping section for use with carpeted floor surfaces. As shown in FIG. 2, the stop comprises a plurality of stainless steel spikes 35 which are inclined forward so that they form an angle from the horizontal, as measured between the front of the door stop 10 and the spikes, of about 50°–60°, as indicated by the angle $\beta$. As best shown in the front view of FIG. 4, the spikes 35 are relatively flat with the greatest dimension being along transverse axis of the body member 10. By way of example, the spikes at the base where they protrude from the bottom of section 14 can be about 1/16" thick, as measured fore and aft, and about 5/16" wide as measured transversely. This configuration provides for ready penetration of the spikes into the carpet surface and good resistance to forward movement when the device is in place while also permitting the door stop to be readily removed.

As shown in FIG. 1, the arrangement of spikes can be simply formed by stamping out triangular spikes from a metal plate 36. The plate 36 can be fastened to the bottom of the gripping section by means of screws 37. The metal plate can be 1/16" thick and stamped out to provide staggered rows of metal teeth about ½" long and 5/16" wide at the base as shown in FIG. 1. Specifically, as indicated in FIG. 1 and also in the front view of FIG. 5, the intermediate row of teeth is staggered with respect to the front and back rows. This distributes the forward force vectors in the carpet generally across the width of the device, lessening the likelihood that the carpet will be tom in the event of an attempt to forcefully open the door. As noted above, the relatively flat configuration of the teeth also provides for a configuration in which the likelihood of the carpet being torn is reduced. In the configuration illustrated, the ratio of the width to the thickness of the teeth is about 5:1. Other configurations can, of course, can be employed, but preferably this ratio will be within the range of about 3–6.

As shown in FIGS. 1 and 2, the elongated body member 10 is largely "hollowed out" and provided with transverse ribs 40 for structural rigidity. The wall thickness of the member 10 can be about 3/16" when formed of polypropylene to provide a lightweight device weighing only a few pounds and yet sufficiently rigid to function in the described manner. Both the pedestal and the ledge portion are provided with cover plates described above in order to allow access to the interior compartments.

Referring to FIG. 3, the plan view of the elongated body member shows the significant reduction in the intermediate body section 16 in the horizontal as well as the vertical configuration. This configuration together with the reduced vertical configuration providing the arch-shaped configuration 18 shown in FIG. 2, enables the device to be readily gripped in the intermediate section by hand.

Figure 5:
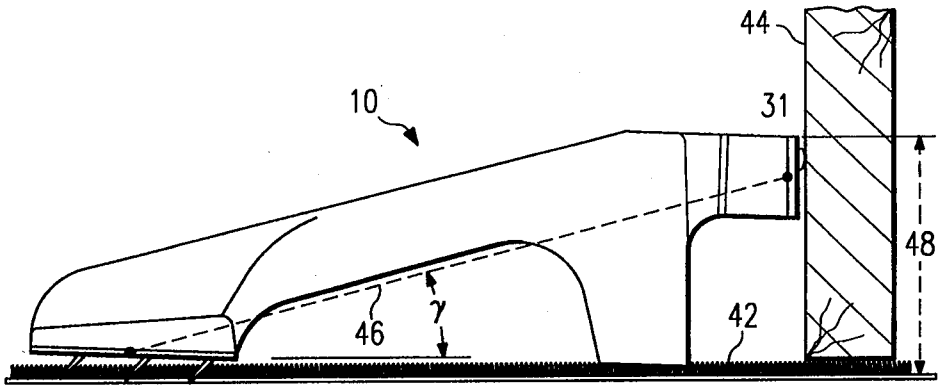
FIG. 5 is a side elevational view showing the door security device in place on a carpet and in an abutting relationship with a door surface.

FIG. 5 is a side elevational view of the stop device 10 in place upon a carpet 42 and in an abutting relationship with a door surface as indicated by reference character 44. As shown because of the slight variation of the bumper face from the vertical by the angle Θ as described above, the bumper facing will normally be parallel to the door surface when the device is in place with the teeth 37 slightly penetrating the carpet. The device can be installed against the door by holding the switch in the "off" position depicted in FIG. 3 above and setting the device in place with the end of the switch lightly touching the door surface 44 and the surface 32*a* spaced by perhaps ⅛" from the door surface. In the event an attempt is made to open the door, the teeth will be driven into the carpet, and continued force on the door will cause the surface 32*a* to become inclined somewhat from the vertical. FIG. 5 also indicates the configuration of the present invention resulting in predominately horizontal force components when the door is open with the device in place. This relationship can be described in terms of the angular displacement between the stop means on the bottom facing of the gripping section and the bumper face 32*a*. It is preferred that from the vertical of the bumper face above the stop means be no more than about 25° from the horizontal. This angle can be measured from the mid point of the stop means, which is taken to be in a plane located about ¼" below the bottom facing of the gripping section, in this case the metal plate, corresponding approximately to the surface of the carpet when the device is in place as shown and into which the spikes slightly protrude as indicated. It is preferred that this angular displacement be no more that 25° from the horizontal.

More specifically, the angle $\gamma$, of a line extending from the vertical mid point of the bumper face 32*a* to the horizontal mid point of the stop means, as indicated by broken line 46 is preferably within the range of 15°–° from the horizontal. This relationship can also be described in terms of the distance of the bumper face 32*a* above the bottom surface of the pedestal 22, and here it is preferred that this distance, indicated by broken line 48 in FIG. 5, be about 2–4 inches.

Figure 6:
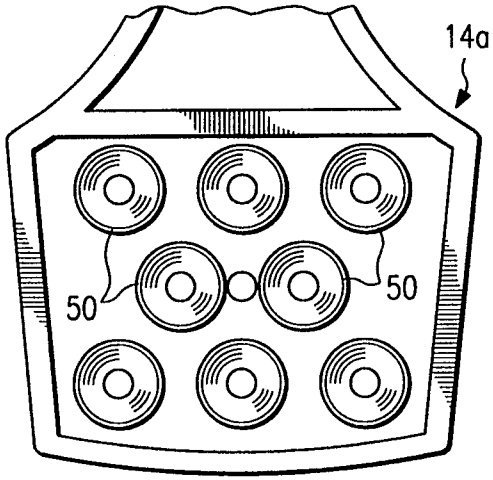
FIG. 6 is a bottom view of the gripping section as modified for use in a room having a hard floor surface.

FIG. 6 illustrates an alternative embodiment of the invention in which the bottom facing of a modified gripping section 14*a* is equipped with an elastomeric material to facilitate use of the door security system on a hard surface such as provided by wood or tile flooring. In this embodiment of the invention, it is preferred, as shown in FIG. 6, that the stop takes the form of a plurality of suction cups 50 which are in a staggered configuration fore and aft in a manner similar to the configuration of the spikes as discussed previously. From the foregoing description, it will be recognized that the major force component transmitted to the gripping section upon the application of force to the door during an unauthorized entry is predominantly horizontal along the longitudinal axis of the device. By thus staggering the suction cups, there is less likelihood of a serious loss of gripping action because of crack in the floor along this axis. In the embodiment of FIG. 6, the angle $\gamma$ is described previously with reference to FIG. 5 can be measured from the plane in which the bottoms of the suction cups lie.

Figure 7:
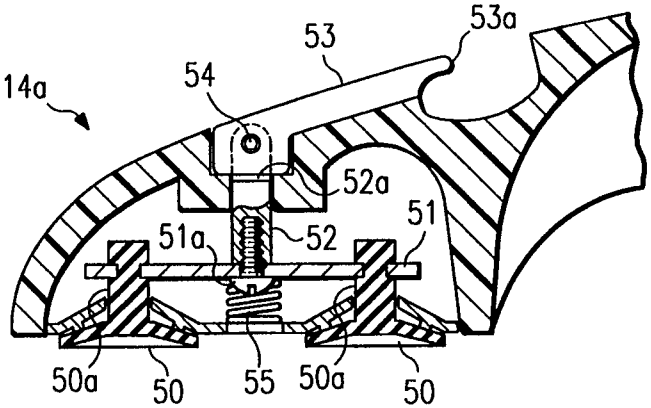
FIG. 7 is a side elevation in section of the modified gripping section of FIG. 6.

FIG. 7 is a side elevational view of the gripping section, with parts broken away, in which a plurality of suction cups are equipped with an actuating mechanism to force the cups downwardly against a floor surface in a manner to activate the suction cups. More particularly and as shown in FIG. 7, a plurality of suction cups 50 are connected through upstanding coupling portions 51*a* to an actuating arm 51. Arm 51 is secured by means of a bolt 51*a* as shown to a rod 52 which is, in turn, in contact at its upper end 52*a* to the cam surface of an actuating handle 53. Handle 53 is rotatably mounted in gripping section 14*a* by means of a pivot connection provided by a pin 54 secured in section 14*a*. The configuration of FIG. 7 can be put in place against the door with the gripping section 14*a* resting on a hard floor surface such as a wooden floor. Handle 53 can then be grasped at the end 53*a* and pulled upwardly to cam the rod downwardly against the force of a compression spring 55 thus exerting a downward force on the suction cups. With the device in place, the arm can be left in the upper position. When it is desired to remove the device and break the suction force, the arm 54 can be forced downwardly to the position shown in FIG. 7, permitting compression spring 55 to bias rod 52 and arm 51 upwardly.

Figure 8:
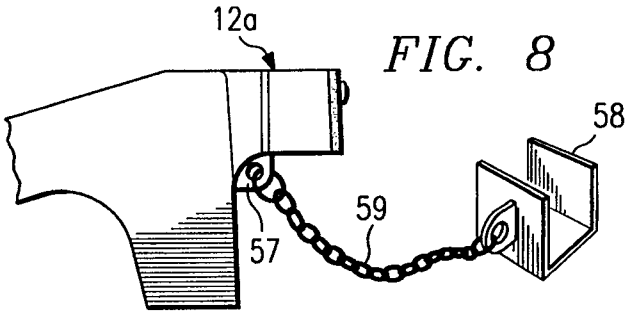
FIG. 8 is a partial perspective view of a security device illustrating another embodiment of the invention.

In yet another embodiment of the invention, there is provided a U-shaped or a bite-shaped channel lock member which is adapted to fit around the vertical edge of the door at which the door security device is placed. This embodiment of the invention is illustrated in FIG. 8 which is perspective view of a head section 12*a* which is modified to provide a grommet 57 as shown. A channel lock member 58 is secured to the device by means of a light chain 59 or other flexible connection means which extends to the grommet 57. This configuration of the invention is especially useful for home use where there is concern that a small child might remove the device from its operative position adjacent a door. Thus as can be seen from an examination of FIG. 8, the channel lock member 58 can be placed around the vertical edge of the door, and the door then shut so as to hold the lock member in place, thus securing the door stop device in close proximity to the door.

Figure 9:
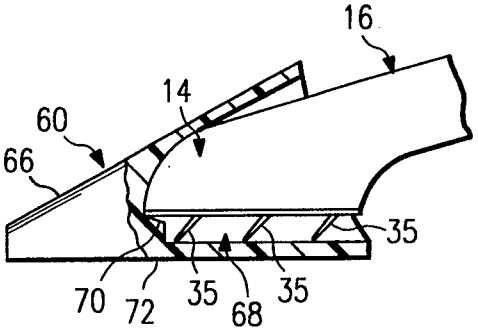
FIG. 9 is a side elevational view with parts broken away showing a further aspect of the invention in which the gripping section is equipped with a guard.
Figure 10:
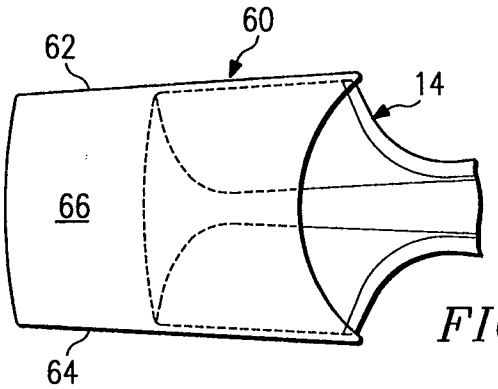
FIG. 10 is a top view of the embodiment of the invention shown in FIG. 9.

In a further aspect of the invention, the gripping section 14 of the door security device is provided with a wedge-shaped guard which functions to cover the gripping teeth so as to lessen the likelihood of inadvertent injury by the gripping teeth during transport and use while also providing a security function in certain limited situations. As illustrated in FIG. 9, the gripping section 14 is provided with a slip over guard 60 which, in the deployed position shown, covers the teeth 35. The guard 60, as shown in FIG. 9 and also in the plan view of FIG. 10, is formulated with side wails 62 and 64 and a downwardly sloping front portion 66. The guard is open at the rear and has an interior chamber 68 conforming at the top generally to the top surface of the gripping section 14 and enlarged at the bottom and to the rear to accommodate teeth 35. The forward section of the gripping section in front of the teeth rests on a ledge 70 within the guard 60 when the guard is in place. Preferably, the bottom surface of the guard is provided with a rubber or other elastomeric high traction surface 72. Thus, with the guard in place as shown, the device can be used as a door security device in a configuration in which the forward portion 66 of the guard is actually placed underneath the door when the room has a hard surface such as wood tile or the like. The reduced section 16 facilitates handling of the door stop when used in this configuration.

Having described specific embodiments of the present invention, it will be understood that modifications thereof may be suggested to those skilled in the art, and it is intended to cover all such modifications as fail within the scope of the appended claims.

I claim:

1. A door security device for preventing the intrusive opening of a door, the combination comprising:

(a) an elongated body member having a head section adapted for employment in proximity to a door, a gripping section longitudinally spaced from said head section and a reduced intermediate portion extending between said head section and said gripping section;

(b) said head section comprising a longitudinally projecting ledge portion a terminus and a pedestal portion displaced inwardly from said terminus and extending downwardly from said ledge portion to a pedestal face adapted to engage a floor;

(c) a bottom facing on said gripping section;

(d) stop secured to said gripping section and depending downwardly from said bottom facing for engaging a horizontal floor surface in a gripping action to limit movement of said body member upon the application of a horizontal force component to said head section in the direction of said gripping section; and (e) a generally vertical bumper face on the terminus of said head section adapted to engage the door and angularly displaced vertically from said stop means on said bottom facing by an angle from the horizontal.

2. The combination of claim 1, wherein the said generally vertical bumper face extends vertically above said bottom facing by a distance of at least two inches.

3. The combination of claim 1, wherein the slope of a line extending from the vertical mid point of said vertical bumper face to the horizontal mid point of said stop means bottom facing is within the range of about 15–20 degrees.

4. The combination of claim 1, wherein said bumper face is inclined from the vertical in the direction of said gripping portion by an angle within the range of 1–3 degrees as measured from the top of said bumper face.

5. The combination of claim 1, wherein said bumper face is formed of an elastomeric material.

6. The combination of claim 1, wherein said stop comprises a plurality of teeth depending downwardly from said bottom facing and inclined forward at an angle from the horizontal.

7. The combination of claim 6, wherein said teeth are relatively flat with the greatest dimension extending transversely of said elongated body member and are arranged in a staggered relationship longitudinally of said elongated body member.

8. The combination of claim 6 further comprising a wedge-shaped guard sloping downwardly from the rear to the front of said guard and having an interior chamber in said guard open at the rear thereof and fitting over said gripping section so at least the forward portion of said gripping section and said teeth are disposed within the interior chamber of said guard, said guard having an elastomeric bottom surface capable of gripping a smooth floor surface.

9. The combination of claim 1, wherein said stop comprises a plurality of downwardly facing suction cups secured to the bottom facing of said gripping section.

10. The combination of claim 9, wherein said suction cups are arranged in a configuration in which they are staggered longitudinally of said elongated body member.

11. The combination of claim 1 further comprising a means in said elongated body member for generating an alarm, switch means for activating said alarm and contact means in said bumper face for activating said switch means.

12. The combination of claim 11, wherein said alarm generating means produces an audio alarm and is positioned in said pedestal portion to generate acoustic energy emanating from an upper portion of said pedestal portion along the underside of said reduced intermediate portion.

13. The combination of claim 1, further comprising a bite shaped channel lock adapted to fit around the vertical edge of a door and a flexible connection interconnecting said channel lock and said elongated body member.

14. The combination of claim 1, wherein said stop comprising an elastomeric material on said bottom facing capable of gripping a smooth floor surface.

15. In a door security system for a room having a door opening fitted with a door jamb, the combination comprising;

(a) a hinged door connected along one edge mounted to said second door jamb by means of hinges allowing said door to swing inwardly and having an exposed second edge adapted to be seated in said door jamb in a closed position and, to extend into said room in an open position;

(b) a security device for said door disposed on the floor of said room in proximity to said door and comprising an elongated body member having a head section adjacent to said door, a gripping section longitudinally spaced from said head section extending inwardly into said room, and an intermediate section of reduced cross section extending between said head section and said gripping section;

(c) a bottom facing on said gripping section;

(d) a stop secured to said gripping section and depending downwardly from said bottom facing for engaging the floor of said room in a gripping action to limit movement of said body member upon the application of a horizontal force component to said head section in the direction of said gripping section;

(e) a generally vertical bumper face on the terminus of said head section and adjacent to the inner surface of said door and angularly displaced vertically from said stop on said bottom facing by an acute angle from the floor to contact said door at a distance within the range of two-four inches above said floor said bumper face being inclined from the vertical in the direction of said gripping portion by an angle within the range of 1–3 degrees as measured from the top of said bumper face;

(f) an alarm in said elongated body;

(g) a switch associated with said alarm for activating the alarm, and (h) a contact member in the upper portion of said bumper face for activating said switch when said door is forced against said security device.

16. A door security device for preventing the intrusive opening of a door, the combination comprising:

(a) an elongated body member having a rearward head section adapted for employment in proximity to a door and a forward gripping section longitudinally spaced from said head section, the top of said elongated body member sloping downwardly from said head section to said gripping section;

(b) a bottom facing on said gripping section;

(c) a generally vertical bumper face on the terminus of said head section and angularly spaced vertically from said bottom facing by an acute angle from the horizontal;

(d) a plurality of teeth on said gripping section depending downwardly from the bottom facing thereof and inclined forward from said bottom facing at an angle; and (e) a wedge-shaped guard sloping downwardly from the rear to the front of said guard and having an interior chamber in said guard open at the rear thereof and fitting over said gripping section so at least the forward portion of said gripping section and said teeth are disposed within the interior chamber of said guard, said guard having an elastomeric bottom surface capable of gripping a smooth floor surface.

17. A door security device for preventing the intrusive opening of a door, the combination comprising:

(a) an elongated body member having a rearward head section, a forward gripping section and intermediate section of a reduced width extending between said head section and said gripping section;

(b) said head section having a rearwardly projecting ledge portion terminating in a generally vertical bumper face adapted to engage a door in an abutting relationship and a pedestal portion displaced inwardly from said bumper face and extending downwardly from said ledge portion to a pedestal face adapted to engage a floor;

(c) said gripping section having a bottom facing and having a stop secured to said gripping section and depending downwardly from said bottom facing for engaging a horizontal floor surface in a gripping action to limit movement of said body member upon the application of a horizontal force component to said head section in the direction of said gripping section; and (d) said intermediate section extending forwardly and downwardly from said head section to said gripping section and being of a generally arched shaped configuration between said pedestal portion and said gripping section so as to define a space between a floor upon which said body member is resting to facilitate handling of said elongated body member.

18. The combination of claim 17 further comprising means in said elongated body member for generating an alarm, switch means for activating said alarm and contact means in said bumper face for activating said switch means.

19. The combination of claim 18, wherein said stop comprises a plurality of teeth depending downwardly from said bottom facing and inclined forward at an angle from the horizontal.

20. The combination of claim 19, wherein said teeth are relatively flat with the greatest dimension extending transversely of said elongated body member and are arranged in a staggered relationship longitudinally of said elongated body member.

21. The combination of claim 17, wherein said stop comprises an elastomeric material on said bottom facing capable of gripping a smooth floor surface.

22. The combination of claim 17, wherein said stop comprises a plurality of downwardly facing suction cups secured to the bottom facing of said gripping section.

23. The combination of claim 22, wherein said suction cups are arranged in a configuration in which they are staggered longitudinally of said elongated body member.

* * * * *